US007836828B2

(12) United States Patent
Martikainen et al.

(10) Patent No.: US 7,836,828 B2
(45) Date of Patent: Nov. 23, 2010

(54) SHOTGUN CARTRIDGE FOR SHOTGUN SHOOTING AND METHOD IN SHOTGUN SHOOTING

(76) Inventors: Kimmo Martikainen, Kortepellontic 80, FI-40900 Säynätsalo (FI); Jaakko Lehtonen, Vatiantic 56, FI-41360 Valkola (FI)

( * ) Notice: Subject to any disclaimer, the term of this patent is extended or adjusted under 35 U.S.C. 154(b) by 140 days.

(21) Appl. No.: 12/085,715

(22) PCT Filed: Dec. 8, 2006

(86) PCT No.: PCT/FI2006/050546

§ 371 (c)(1),
(2), (4) Date: May 28, 2008

(87) PCT Pub. No.: WO2007/065977

PCT Pub. Date: Jun. 14, 2007

(65) Prior Publication Data

US 2009/0260535 A1 Oct. 22, 2009

(30) Foreign Application Priority Data

Dec. 9, 2005 (FI) ..... 20055655

(51) Int. Cl.
*F42B 7/02* (2006.01)

(52) U.S. Cl. ..... 102/458; 102/513

(58) Field of Classification Search ..... 102/458, 102/449, 448–463, 513
See application file for complete search history.

(56) References Cited

U.S. PATENT DOCUMENTS 1,887,989 A * 11/1932 Nimmo et al. ..... 102/458
1,887,990 A * 11/1932 Brownsdon et al. ..... 102/458
3,262,390 A * 7/1966 Cowles et al. ..... 102/458
3,405,638 A * 10/1968 Stoner, Jr. ..... 102/449
5,361,701 A * 11/1994 Stevens ..... 102/450
5,429,054 A * 7/1995 Topping ..... 102/458
7,174,833 B2 * 2/2007 Diller ..... 102/458
7,228,801 B2 * 6/2007 Dunnam et al. ..... 102/458
7,610,857 B1 * 11/2009 Dunnam et al. ..... 102/458
2004/0159260 A1 8/2004 Diller
2005/0056184 A1 3/2005 Dunnam et al.
2005/0188882 A1 * 9/2005 Diller ..... 102/458

* cited by examiner

*Primary Examiner*—Michelle Clement
(74) *Attorney, Agent, or Firm*—Fildes & Outland, P.C.

(57) ABSTRACT

The invention relates to a shotgun cartridge for shotgun shooting. The shotgun cartridge includes a case and a case head in it, in the vicinity of a primer arranged in which, a propelling charge is arranged. Inside the case is a shot wad with shot pellets arranged inside it, which are arranged on the opposite side of the propelling charge to the primer, and between the propelling charge and the shot pellets is a gas wad. In addition, the shotgun cartridge includes a indicator piece, arranged inside the shot wad, on the shot pellets side of the gas wad, in which there is a space for a indicator agent. The indicator piece is arranged to be ejected from the case when the shotgun cartridge is fired by igniting the propelling charge with the primer. The outer diameter of the indicator piece essentially corresponds to the inner diameter of the shot wad, and the indicator piece is arranged against the end wall of the shot wad with the shot pellets lying freely against the indicator piece. In addition, the indicator agent is a fine-particle incombustible substance, which is arranged loosely in the space.

13 Claims, 3 Drawing Sheets

SHOTGUN CARTRIDGE FOR SHOTGUN SHOOTING AND METHOD IN SHOTGUN SHOOTING

Figure 1C:
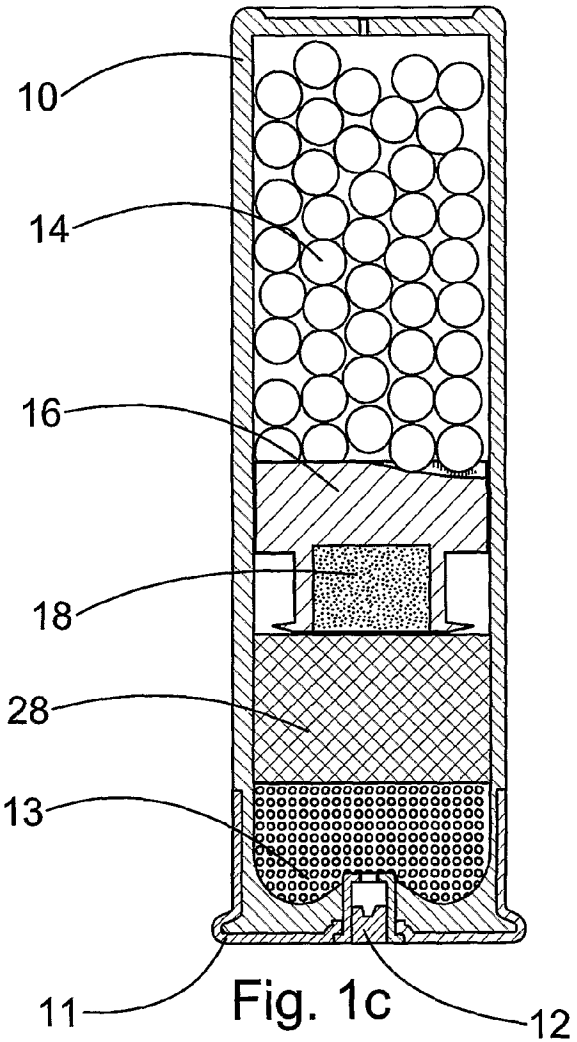

The present invention relates to a shotgun cartridge for shot-gun shooting, which shotgun cartridge includes a case and a case head at one end of it, a primer arranged in the case head and a propelling charge in the vicinity of it, a shot wad inside the case and shot pellets arranged inside it, which are arranged on the opposite side of the propelling charge to the primer, a gas wad between the propelling charge and the shot pellets, and a indicator piece, in which there is space for a indicator agent, arranged inside the shot wad, on the shot pellets side of the gas wad, which indicator piece is arranged to be ejected from the case when the shotgun cartridge is fired by igniting the propelling charge with the primer. The invention also relates to a method in shotgun shooting.

US patent application number 2005/0056184 discloses a shotgun cartridge for use in a shotgun. In a known manner, the shotgun cartridge includes a case, in which there is a case head. Mainly inside the case head there is a propelling charge, for the igniting of which there is also a primer in the case head. Inside the case, immediately after the propelling charge, there is a indicator piece, in which there is a space for a indicator agent. After the indicator piece, there is a shot wad, to which shot pellets are fitted. In addition, the opposite end of the case to the case head is closed. Such a shotgun cartridge is loaded into the shotgun and is fired by using the primer to ignite the propelling charge. The shot wad with the shot pellets and the indicator piece are then ejected from the case. The ignition of the propelling charge also ignites the indicator agent, which burns brilliantly as the indicator piece flies. On the basis of the brilliance the shooter, for example, can observe the flight path of the shot pellets and use this as a basis for determining possible errors in shotgun shooting.

In the patent application described, the indicator piece also acts as a gas wad and over its entire length lies tightly against the inner surface of the case. This takes up part of the power of the propelling charge and hinders the charging of the shotgun cartridge. The indicator piece is also intended to fly for a long distance over essentially the same path as the shot pellets. Thus the indicator piece must be sufficiently incompressible and heavy to achieve a sufficiently long flight. Thus the indicator piece consumes an increasing amount of the power of the propelling charge. In practice, due to the indicator piece the normal charging of a shotgun cartridge must also be changed. For example, the amount of powder in the propelling charge may even have to be increased, or at least the powder grade must be changed. The changes have a detrimental effect on, among other things, the shot-pellets pattern achieved by the shotgun cartridge while the increase in weight will also increase the recoil when firing. In other words, when using the indicator piece, the entire shotgun cartridge and its components must be re-dimensioned and even manufactured anew, which will increase manufacturing costs. Some of the components are also specially manufactured and are only suitable for use with particular types of shotgun cartridges. In addition, due to the stiff indicator piece the shotgun cartridge lacks cushioning, which especially in clay-pigeon shooting is an essential requirement. The indicator agent, which burns for a long time, is also a fire risk, which restricts the use of the shotgun cartridge. In addition, the indicator piece, which flies for a long way, may even prevent the entire shotgun shooting, on account of the increasing safety distance. The indicator piece also has a deleterious effect on the operation and accuracy of the shotgun cartridge. In a known manner, the shot wad opens after firing. In the patent application described, the shot wad interferes, however, with the flight of the indicator piece that follows it, so that it is largely certain that its flight path will differ from that of the shot pellets. This will introduce a further error to the determining of errors, and will be increased by the long-burning indicator agent. In practice, when determining an error, the shooter must also take into account how far the indicator piece has already flown. The brilliant light may also interfere with shooting.

The invention is intended to create a new type of shotgun cartridge for shotgun shooting, by means of which the required properties are achieved despite a indicator piece, and by means of which the drawbacks of the prior art are avoided. In addition, the invention is intended to create a new type of method for shotgun shooting, which is simpler than previously and by means of which possible errors can be determined more accurately than previously. The characteristic features of the shotgun cartridge according to the present invention are stated in the accompanying Claim 1. Correspondingly, the characteristic features of the method according to the invention are stated in the accompanying Claim 8. In the shotgun cartridge according to the invention, a new type of indicator piece is used, which is additionally located in a new and surprising manner. In addition, the indicator agent is of a new type and its observation is arranged in manner that differs from that known. The indicator piece can be fitted to different kinds of shotgun cartridges, without their properties being significantly reduced. In practice, conventional components can be used in the shotgun cartridge, independently of their manufacturer. In addition, the risk of fire is avoided while the safety distances in shotgun shooting remain unchanged. At the same time, dirtying of the barrel of the shotgun is avoided. In the method according to the invention, the shooter can, at a single glance, determine a possible error in shooting. At the same time, spectators can follow shotgun shooting better than before.

Figure 1B:
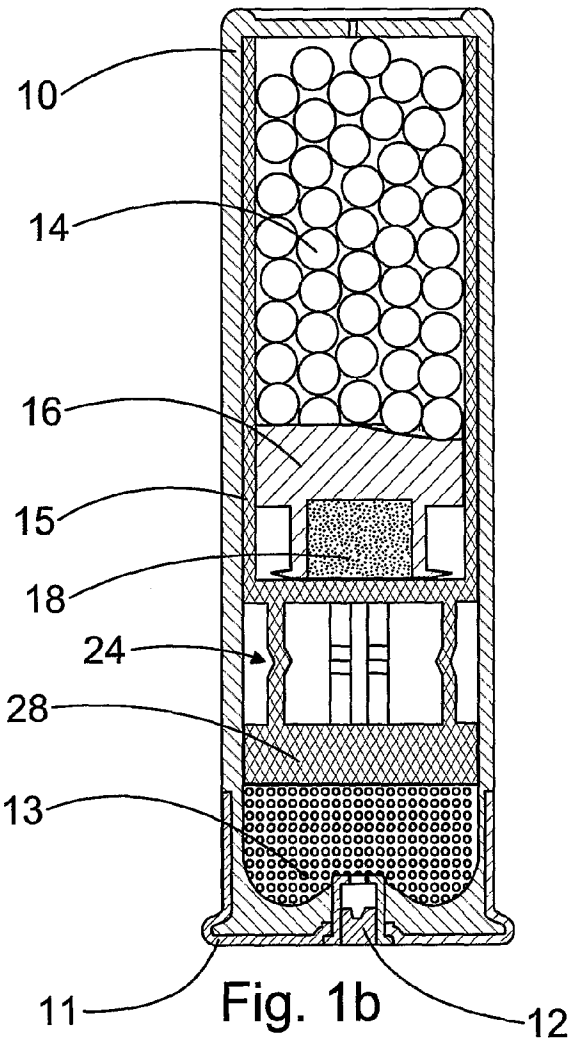
Figure 1A:
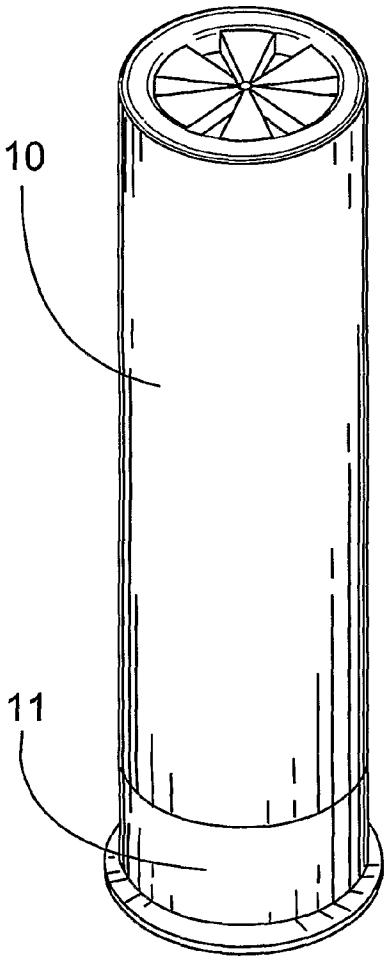
Figure 2C:
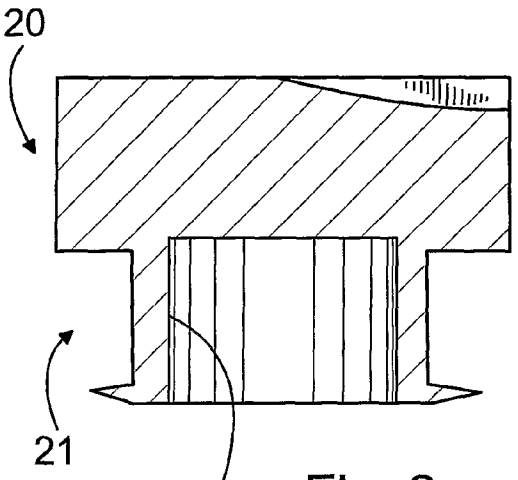
Figure 2B:
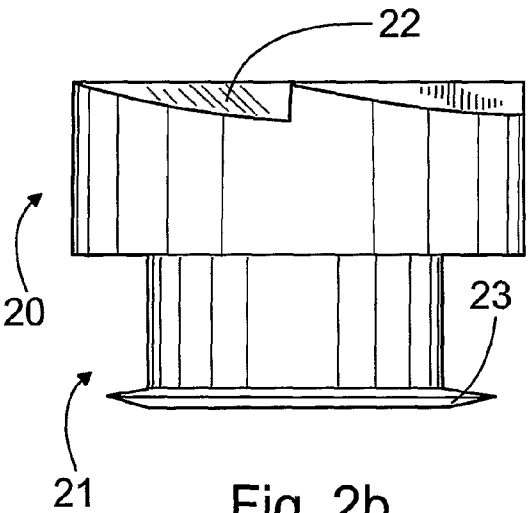
Figure 2A:
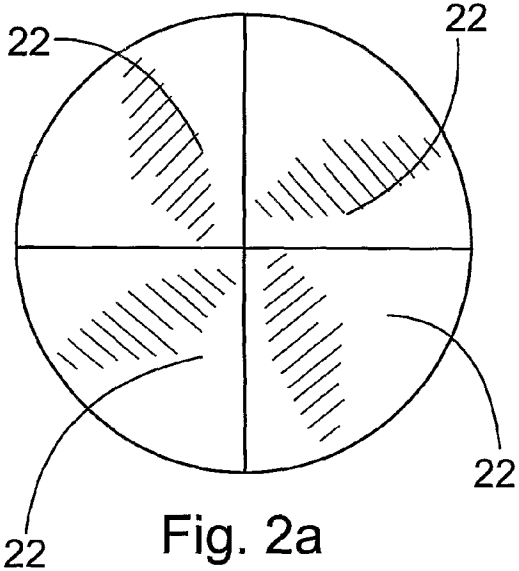
Figure 2D:
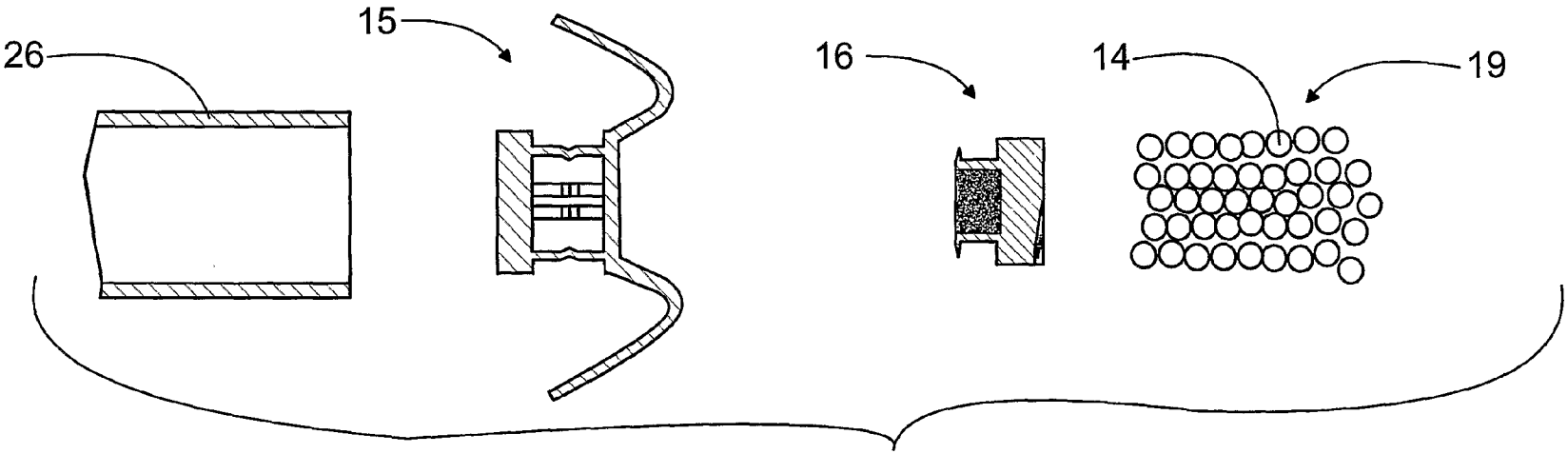
Figures 3A, 3B:
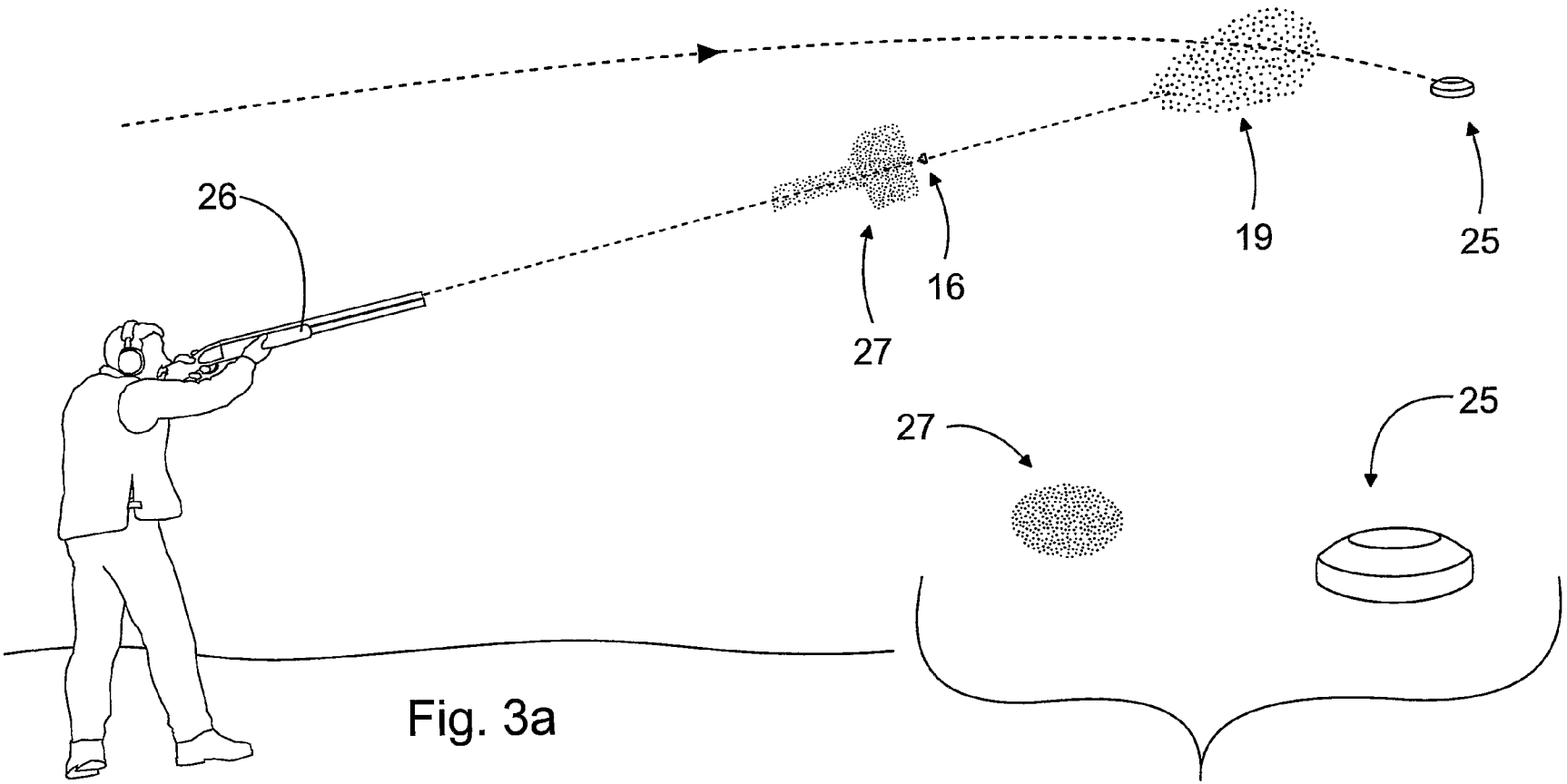

In the following, the invention is examined in detail with reference to the accompanying drawings depicting some applications of the invention, in which FIG. 1*a* shows an axonometric view of the shotgun cartridge according to the invention, FIG. 1*b* shows a cross section of the shotgun cartridge according to the invention, FIG. 1*c* shows a cross section of a second application of the shotgun cartridge according to the invention, FIG. 2*a* shows a front view of the indicator piece according to the invention, FIG. 2*b* shows a side view of the indicator piece according to the invention, FIG. 2*c* shows a cross section of the indicator piece of FIG. 2*b*, FIG. 2*d* shows the indicator piece according to the invention, after ejection from the barrel of the shotgun, FIG. 3*a* shows a schematic diagram of shotgun shooting using a shotgun cartridge according to the invention, FIG. 3*b* shows a view at the moment of firing, seen in the shooter's view.

FIG. 1*a* shows the shotgun cartridge according to the invention, which is intended for shotgun shooting. The shotgun cartridge includes a case 10, which is usually manufactured from cardboard or plastic. A case head 11 is fitted to one end of the case 10, and is usually made from brass. The case with its head can also be made as a single plastic piece. The case and its head determine the size of the cartridge, which can vary, but is nevertheless defined generally. In practice, the caliber of the shotgun determines the diameter and length of the case used. This allows the correct kind of shotgun cartridges to be selected for each shotgun on the basis of caliber. In connection with the caliber of the shotgun, the length of the case is generally also stated as a nominal dimension in millimetres. Most usually, the length of the case is 70 or 76 mm.

FIG. 1*b* shows a cross section of the shotgun cartridge according to the invention. A primer 12, which is also referred to as a detonator, is attached to the case head 11. Next in the shotgun cartridge is a propelling charge 13, which is arranged in the vicinity of the primer 12. The propelling charge is usually mainly of gunpowder, the amount and composition of which can vary in different shotgun cartridges. The effect of the shotgun cartridge is based on shot pellets 14. In addition, between the propelling charge 13 and the shot pellets 14 there is a gas wad 28, which prevents the pressure caused by the burning of the propelling charge from escaping. The shot pellets are traditionally of lead, though other metals and materials with a sufficiently high specific weight can also be used. In the application of FIG. 1*b*, the shotgun cartridge also includes a shot wad 15, which is arranged on the opposite side of the propelling charge 13 to the primer 12. Thus, when the propelling charge ignites, the shot pellets first leaves the case and finally the barrel of the shotgun. In the barrel of the shotgun, the shot pellets remains in the shot wad, but when it exits the shot wad opens.

The shotgun cartridge according to the invention is advantageous, particularly when practising shotgun shooting, or when determining possible errors that may occur in it. In practice, it is difficult and even impossible to determine the flight path of the shot-pellet swarm. In order to facilitate observation, a indicator piece 16 is arranged inside the case 10, in which there is a space 17 for a indicator agent 18. The indicator agent is used to create a visible phenomenon, which can be used as an aid in determining errors. Though the outer diameter of the indicator piece essentially corresponds to the inner diameter of the case, it is arranged to leave the case when the shotgun cartridge is fired by using the primer to ignite the propelling charge. In other words, the indicator piece exits together with the shot pellets. According to the invention, the indicator piece 16 is arranged on the shot pellets 14 side of the gas wad 28. In the application of FIG. 1*b*, the indicator piece 16 is, in addition, arranged inside the shot wad 15, in which case the outer diameter of the indicator piece essentially corresponds to the inner diameter of the shot wad. In firing, the indicator piece is released from the shot wad immediately this opens, thus avoiding a detrimental effect from the shot wad on the flight path of the indicator piece. In addition, according to the invention, the indicator agent 18 is a fine-particle incombustible substance, which is arranged loosely inside the space 17. In other words, the indicator agent is released without detrimental combustion, due to the movement of the indicator piece. The location of the indicator piece in the shot wad prevents, in addition, the ignition of the indicator agent, which permits the use of very different kinds of indicator agent. In addition, the indicator agent is only released outside the barrel of the shotgun, so that the dirtying of the barrel is avoided.

According to FIG. 1*b*, the indicator piece 16 is preferably arranged against the end wall of the shot wad 15, with the shot pellets 14 lying against the indicator piece 16. Thus the shot pellets form a unified shot-pellet swarm, with the indicator piece following the shot pellets and releasing the indicator agent. The shot-pellet swarm 19 is shown in FIGS. 2*d* and 3*a*.

In FIG. 1*b*, the indicator piece 16 is full of indicator agent 18, which, according to the invention, is entirely or partly a colour substance. This easily creates sufficient visibility. In addition, the spreading of the indicator agent can be regulated by altering the composition of the indicator agent. For example, the indicator agent can be placed in the space first, after which the rest of the space is filled with a loose substance with poorer visibility. In this way, it is possible to adjust the spreading moment and duration of the indicator agent for different applications. In tests, the indicator agent used was coloured gypsum, which is incombustible and which remains operational even when stored. In other words, though the humidity or temperature of the air change, the properties of the indicator agent remain unaltered. The space 17 is shown in the cross section of the indicator piece shown in FIG. 2*c*. In practice, the indicator piece is filled with indicator agent and the shotgun cartridge is charged. After the installation of the propelling charge and the gas wad, the indicator piece according to the invention is fitted to the case. Next the shot pellets are added, which rest freely on top of the indicator piece. Finally the case is closed. By fitting the indicator piece against the end wall of the shot wad, the indicator agent will remain inside the indicator piece without separate wads or similar. In addition, at the moment of firing, the indicator agent is first packed into the space by the force of the propelling charge, but very soon it begins to be released due to the movement of the indicator piece. The charging of the shotgun cartridge can be facilitated by closing the space, for example, with protective paper, which breaks at the moment of firing. In other words, the protective paper prevents the indicator agent from falling out, which facilitates the handling of the indicator piece and the charging of the shotgun cartridge.

According to the invention, the indicator piece 16 is formed of an end piece 20 and a body piece 21, which forms a continuation of it and in which the space 17 is arranged. In this way, the centre of gravity of the indicator piece is brought to an advantageous point and the shape of the indicator piece can be altered. Preferably, the face surface of the indicator piece is shaped in such a way that the air resistance creates a rotational movement in the indicator piece around its central axis. The rotation improves the accuracy of the flight of the indicator piece and the release of the indicator agent from the space. Generally, there are at least two bevels 22 in the face surface, which are arranged symmetrically relative to the central axis of the indicator piece 16. Thus the structure of the indicator piece remains balanced and the axis of rotation corresponds to the central axis of the trace piece. In the applications of FIGS. 2*a* -2*c*, there are four bevels 22 in the face surface. In addition, there is a lip 23 in the bottom part of the body piece, which stabilizes the flight of the indicator piece. The indicator piece is preferably a unified piece, which can be manufactured, for example, by pressing in a mould.

In practice, the specific weight of the indicator piece is 0.5-5.0, preferably 2.0-4.0 g/cm$^3$. In practice, the indicator piece is then lighter than the shot pellets and flies for a shorter distance than the shot pellets. The important part, however, is a precise and undisturbed flight path in the initial stage. The indicator piece can be made from nearly any material whatever, but is preferably made from plastic or a combination of plastics. In addition, other relatively light materials can be used, such as compressed cardboard. Biodegradable materials are also possible. The operation of the shotgun cartridge is described in greater detail in connection with the method according to the invention. For example, a indicator piece intended for a 12-caliber shotgun cartridge is about ten millimetres high and has in it a cylindrical space, the depth of which is less than the diameter. Thus the indicator agent will discharge reliably from the indicator piece and the discharge will be momentary. In the indicator piece in question, the volume of the space is about 0.4 $cm^3$.

By placing the indicator piece in the shot wad, it is also possible to use cushioning in the shotgun cartridge. According to the invention, the shot wad 15 is preferably arranged as part of the gas wad 28. In addition, there is an cushioning part 24 between the shot wad 15 and the gas wad 28 (FIG. 1*b*). In practice, the cushioning part is compressed slightly during firing to create cushioning. When the shotgun cartridge according to the invention is charged, shot wads and cushioning parts made form many different kinds of materials, as well as existing shot wads and cushioning parts can be used. Correspondingly, FIG. 1*c* shows an application without a shot wad. In this case, a simple gas wad 28 is used after the propelling charge, and after that the indicator piece 16 is set in place and finally the case 12 is closed. In the second application too the shot pellets 14 lie against the indicator piece 16. Here, the gas wad 28 is thicker than in the previous application and is also arranged to act as an cushioning piece. A simple gas wad can be of cardboard, for example, whereas a gas wad that is equipped with a shot wad is preferably of plastic. The same reference numbers are used for parts that are functionally similar.

Generally in shotgun shooting, a target 25, which is put into a flight path, is shot with a shotgun 26. FIG. 3*a* shows clay-pigeon shooting as an example application. In the method, a shotgun cartridge, inside which there are not only shot pellets 14, but also a indicator piece 16 (FIGS. 1*b* and 1*c*) containing a indicator agent 18 is used in the shotgun 26. When the indicator piece exits from the shotgun cartridge when the shotgun is fired, it is possible to determine possible errors in shotgun shooting. For example, in FIG. 3*a* there has probably been too small a deflection as the shot-pellet swarm 19 have missed the clay pigeon that is the target 25. According to the invention, a fine-particle incombustible substance is used as the indicator agent, which is arranged in the indicator piece 16 to create a momentarily separately observable indicator-agent cloud 27 at the moment of firing. FIG. 3*a* also shows the indicator piece 16 and the indicator agent released from it, from which the indicator-agent cloud 27 is formed. After the barrel of the shotgun 26, the indicator piece 16 flies essentially on the flight path of the shot-pellet swarm 19, but remains behind the shot pellets. FIG. 2*d* shows a situation in which the shot wad 15 as well as the indicator piece 16 and the shot pellets 14 are ejected from the barrel of the shotgun. The shot wad 15 opens completely very rapidly without disturbing the flight of the indicator piece 16 and the shot pellets 14. Thus the shot-pellet pattern created by the shotgun cartridge remains good. In addition, the indicator piece 16 follows the shot-pellet swarm 19 in its wake. In other words, even a light indicator piece will fly sufficiently far. As the indicator piece falls slightly farther behind the shot-pellet swarm, the air resistance acting on the indicator piece increases. The indicator piece then begins to rotate, mainly due to the shape of its face surface, when most of the indicator agent is released, forming a mushroom-shaped indicator-agent cloud when seen from the side (FIG. 3*a*). The indicator agent is intentionally arranged to be released rapidly, in order to avoid long flight paths of the indicator piece, which would interfere with observation. In fact, at the moment of firing, the shooter sees not only the target, but also one narrow indicator-agent cloud 27, according to FIG. 3*b*. Thus, the shooter sees the point at which the shotgun fired. In addition, the indicator-agent cloud can be clearly seen, but will not be too strong or dazzling. Thus the movement of the gaze away from the target is avoided. Particularly in shotgun shooting, the shotgun is aimed on the basis of the target, without actual sights. In other words, the gaze of the shooter must be focussed on the target.

According to the invention, a possible error and its magnitude are determined from the distance between the indicator-agent cloud 27 and the target 25, at the moment of firing. In practice, the moment of firing is a very short period of time, in which the shot pellets leave the case and intersect the flight path of the target. Thus, a momentary phenomenon is sufficient to show possible errors, without excessive thinking and calculation. When the shot-pellet swarm meets the target, the indicator-agent cloud seen by the shooter at least partly obscures the target at the moment of firing, which indicates that the shot has succeeded. FIG. 3*b* shows the situation in the case of an unsuccessful shot. In practice, the exit velocity of the shot pellets in a shotgun cartridge is about 300-500 m/s, more usually 350-450 m/s. When possibly changing to shot pellets of iron or other materials lighter than lead, the impact energy may be further increased by increasing the velocity.

Thus, unlike the prior art, it is desired that the indicator agent will only create a momentary phenomenon. According to the invention, the shotgun cartridge is arranged in such a way that the indicator agent 18 discharges from the indicator piece 16 between the shotgun 26 and the intersection points of the shot pellets 14 and the target 25 (FIG. 3*a*). This is achieved by using a special indicator piece and a loose indicator agent arranged in it. By altering their properties, the time and duration of the discharge of the indicator agent can be adjusted. Generally, the indicator piece is arranged in such a way that at least most of the indicator agent discharges form the indicator piece within 2-10, more preferably 4-8 milliseconds. The length of the indicator-agent cloud will then be about one and a half metres, more generally from one to three metres. In any case, the indicator agent only discharges after the barrel of the shotgun, thus avoiding dirtying the barrel. On the basis of practical tests, using a charge intended for conventional clay-pigeon shooting the indicator-agent cloud will form at a distance of 10-30, more preferably 15-25 metres from the shotgun. By altering the charge, the indicator piece and/or the indicator agent, the discharge time and duration can be adjusted to suit every situation.

The indicator piece according to the invention is suitable for different kinds of shotgun cartridges, the properties and particularly the ease of use of which remain nearly unchanged. The indicator piece is dimensioned mainly according to the caliber of the shotgun cartridge. In addition, in the shotgun cartridge it is possible to use cushioning, which is essential especially in long shooting performances. The loose and incombustible indicator agent is cheap and safe to use. There are also considerably more colour alternatives than previously while the indicator piece does not restrict the use of the shotgun cartridge. By means of a suitable choice of materials the indicator piece can be recycled and used even in refilling. An important factor is also the momentary indicator-agent cloud, on the basis of which possible errors can be determined with one glance without thinking. This accelerates the correction of errors and thus considerably helps the practice of shotgun shooting. The indicator-agent cloud also improves the spectator effect of shotgun shooting.

The invention claimed is:

1. Shotgun cartridge for shotgun shooting, said shotgun cartridge comprising:

a case and a case head at one end of said case, a primer arranged in the case head and a propelling charge in the vicinity of said primer, a shot wad inside the case and shot pellets arranged inside said shot wad, which is arranged on the opposite side of the propelling charge to the primer, a gas wad between the propelling charge and the shot pellets, and an indicator piece having a space containing an indicator agent, said indicator piece being arranged inside the shot wad, on the shot pellet side of the gas wad, and said indicator piece being ejectable from the case when the shotgun cartridge is fired by igniting the propelling charge with the primer, characterized in that the indicator piece has an outer diameter essentially corresponding to an inner diameter of the shot wad, the shot wad has an end wall against which the indicator piece is arranged with the shot pellets lying freely against the indicator piece, and the indicator agent is a fine-particle incombustible substance, which is arranged loosely in the space.

2. Shotgun cartridge according to claim 1, characterized in that the shot wad is arranged to be part of the gas wad and there is a cushioning part between the shot wad and the gas wad.

3. Shotgun cartridge according to claim 2, characterized in that the indicator agent is partly or entirely a coloured substance.

4. Shotgun cartridge according to claim 3, characterized in that the indicator piece is formed from an end piece and a body piece that is a continuation of said end piece, the space being arranged in said body piece.

5. Shotgun cartridge according to claim 4, characterized in that the end piece has a face surface which is shaped in such a way that air resistance creates a rotational motion in the indicator piece, which releases the indicator agent.

6. Shotgun cartridge according to claim 5, characterized in that the indicator piece has a central axis, and there are at least two bevels in the face surface, which are arranged symmetrically relative to said central axis.

7. Shotgun cartridge according to claim 6, characterized in that the specific weight of the indicator piece is 0.5-5.0 g/m$^3$.

8. Method of shotgun shooting a target sent into a flight path, said method comprising the steps of:

using a shotgun cartridge in a shotgun, said shotgun cartridge including a shot wad, shot pellets and an indicator piece containing an indicator agent, said shot pellets and said indicator piece being fitted inside the shot wad, which is arranged to exit from the shotgun cartridge when the shotgun is fired, in order to determine possible errors in shotgun shooting, wherein said indicator piece has an outer diameter essentially corresponding to an inner diameter of the shot wad, the shot wad has an end wall against which the indicator piece is fitted, and the shot pellets lie freely against the indicator piece;

using a fine-particle incombustible substance as the indicator agent, which is arranged loosely in the indicator piece, in order to form a momentarily observable indicator-agent cloud at the moment of firing.

9. Method according to claim 8, characterized in that a possible error and its magnitude are determined from the distance between the indicator-agent cloud and the target at the moment of firing.

10. Method according to claim 9, characterized in that the shotgun cartridge is arranged in such a way that the indicator agent discharges from the indicator piece between the shotgun and the intersection point of the flight paths of the shot pellets and the target.

11. Method according to any of claim 10, characterized in that the indicator piece is arranged in such a way that the indicator agent discharges from the indicator piece within 2-10 milliseconds.

12. Shotgun cartridge according to claim 6, characterized in that the specific weight of the indicator piece is 2.0-4.0 g/m$^3$.

13. Method according to any of claim 10, characterized in that the indicator piece is arranged in such a way that the indicator agent discharges from the indicator piece within 4-8 milliseconds.

* * * * *